United States Patent [19]

Baratpour et al.

[11] Patent Number: 4,852,885

[45] Date of Patent: Aug. 1, 1989

[54] GAME DEVICE

[76] Inventors: Shahin Baratpour; Salina Ventresca, both of 110 Wheeler Ave., Mass. 02176

[21] Appl. No.: 108,013

[22] Filed: Oct. 14, 1987

[51] Int. Cl.[4] ..... A63F 3/00

[52] U.S. Cl. ..... 273/237; 273/240; 273/272; 273/142 J

[58] Field of Search ..... 273/142 R, 142 B, 142 H, 273/142 J, 142 JA, 142 JB, 142 JC, 142 JD, 142 K, 240, 272, 237

[56] References Cited

U.S. PATENT DOCUMENTS

| | | | |
|---|---|---|---|
| 1,837,194 | 12/1931 | Baumgarten | 273/142 JA |
| 2,380,106 | 7/1945 | Hilton | 273/272 |
| 3,226,122 | 12/1965 | Rogers | 273/142 R |
| 3,232,622 | 2/1966 | Lambert | 273/142 R |
| 3,603,592 | 9/1971 | Bury . | |
| 3,841,637 | 10/1974 | Piazza et al. | 273/142 K |
| 4,643,425 | 2/1987 | Herzenberger | 273/142 B |
| 4,772,027 | 9/1988 | Martel et al. | 273/237 |

FOREIGN PATENT DOCUMENTS

| | | | |
|---|---|---|---|
| 552508 | 4/1943 | United Kingdom | 273/272 |

*Primary Examiner*—Edward M. Coven
*Assistant Examiner*—Benjamin Layno
*Attorney, Agent, or Firm*—Jerry T. Kearns

[57] ABSTRACT

A fast action game includes a wheel imprinted with the letters of the alphabet and numbers. The wheel is rapidly rotated by a motor in response to player actuation of a switch. When the switch is released, the wheel will coast to a stop with an indicator pointing to one of the letters or numbers on the wheel. Players then complete a scoresheet printed with various categories of items with a word beginning with the letter indicated by the wheel. If the wheel indicates a number preselected by one player, the player receives a bonus score. Play continues until all categories are completed by one player. A scoring system enables the determination of the finish rank of the other players.

1 Claim, 4 Drawing Sheets

| SUBJECT | 1 | 2 | 3 | 4 | 5 | PT |
|---|---|---|---|---|---|---|
| NAME | | | | | | 10 |
| FRUIT | | | | | | 30 |
| CITY | | | | | | 20 |
| ITEM | | | | | | 10 |
| ANIMAL | | | | | | 40 |
| COLOR | | | | | | 30 |
| CAR | | | | | | 40 |
| COUNTRY | | | | | | 30 |
| FLOWER | | | | | | 40 |
| FAMOUS PEOPLE | | | | | | 30 |
| | | | | | | |

24

FIG 5

GAME DEVICE

BACKGROUND OF THE INVENTION

1. Field of the Invention

The present invention relates to game devices, and more particularly pertains to a new and improved fast action word game. Various types of word games are known in the prior art. These types of games are generally slow-paced and can become long and monotonous affairs. The present invention combines the elements of a word game with the random chance aspects of a spinning wheel to provide a very fast paced, exciting game. The game of the present invention may be distinguished from the various types of conventional games by the fast pace, and by the fact that one game may be completed in a relatively short time period.

2. Description of the Prior Art

Various types of game devices are known in the prior art. A typical example of such a game device is to be found in U.S. Pat. No. 3,480,278, which issued to W. Conley on Nov. 25, 1969. This device utilizes a playing board having horizontal rows of numbers and letters. The letters are arranged according to their relative frequency of appearance. The playing board also provides a plurality of horizontal lanes to receive cubical playing pieces. The playing pieces are imprinted with various numbers and letters. The playing of the game involves the spelling of various words determined by a random selection of a letter. U.S. Pat. No. 3,606,336, which issued to J. Krause on Sept. 20, 1971, discloses a word association game which includes an indicator board having a series of alphabet letters and a series of numerals peripherally spaced thereon, with a rotatable pointer associated therewith to be spun to indicate a number and a letter, to aid in starting the game, and to be spun to indicate a numeral to aid in continuing the game. Lettered playing pieces, each having a first letter on two opposed faces, and an index letter on each of the two opposed faces differing only in size from the letter on the opposite face, are provided to enable the building of words as indicated by the chance selected letter and number for the starting play and by chance selected letter and number to form subsequent words. U.S. Pat. No. 4,055,347, which issued to L. Kreischer on Oct. 25, 1977, discloses a game board with a series of spaced letters of the alphabet forming a continuous path along which game pieces are moved. Letter tiles, determined by the letter spaces to which game pieces are moved, are purchased. Words from such letters are placed on a player's own wood board, which has a limited number of horizontal and vertical spaces. There are four groups of letters, each valued in accordance with the difficulty of forming words therewith, and play money is awarded to players for the total of words formed. U.S. Pat. No. 4,106,773, which issued to N. Coefield on Aug. 15, 1978, discloses a crossword puzzle game which utilizes a typical crossword puzzle board and a timer. The contestants take turns filling in the crossword puzzle, each contestant using a different one of the writing instruments and the lengths of their turns being measured by the timer. Values are assigned to each square in a crossword puzzle, and the winner of the game is determined at the end of play by adding up the values assigned to each square filled in correctly in each color. U.S. Pat. No. 4,341,389, which issued to B. Dumont on July 27, 1982, discloses a word finding and guessing game. The game utilizes a hinged case having lanes formed for the reception of various numbered and lettered game tiles. U.S. Pat. No. 4,509,758, which issued to J. Cole on Apr. 9, 1985, discloses a cryptographic game apparatus including an encrypting box with a plurality of alphabetically labeled compartments, a plurality of alphabetically labeled members for random insertion within the compartments, a first pad of sheets containing messages to be encrypted, and a second pad of sheets employed by players to decipher the encrypted message.

While the above mentioned devices are suited for their intended usage, none of these devices provides a game with a motorized spinning wheel in conjunction with a score sheet imprinted with various categories to be completed in accordance with the spin of the wheel. Further, none of the aforesaid game devices provides a fast paced word game which allows players to make use of their general knowledge, as well as their quick reflexes. Additionally, none of the previously described games makes use of a motorized spinning wheel which may be independently actuated by a number of switches provided for each player. Inasmuch as the art is relatively crowded with respect to these various types of game devices, it can be appreciated that there is a continuing need for and interest in improvements to such game devices, and in this respect, the present invention addresses this need and interest.

SUMMARY OF THE INVENTION

In view of the foregoing disadvantages inherent in the known types of game devices now present in the prior art, the present invention provides an improved game device. As such, the general purpose of the present invention, which will be described subsequently in greater detail, is to provide a new and improved game device which has all the advantages of the prior art game devices and none of the disadvantages.

To attain this, representative embodiments of the concepts of the present invention are illustrated in the drawings and make use of a motorized spinning wheel imprinted with the letters of the alphabet and several numbers. The present invention also utilizes a plurality of switches, wired in parallel, such that activation of any switch will cause the wheel to spin. The game device of the present invention also utilizes a score sheet imprinted with a variety of categories to be completed by a letter indicated by the spin of the wheel. Various point totals are assigned to each category according to their relative difficulty. An additional feature of the present invention is the provision of various numbers on the wheel so that a player may be awarded bonus points if their preselected number is indicated upon a spin of the wheel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game device which has all the advantages of the prior art game devices and none of the disadvantages.

It is another object of the present invention to provide a new and improved game device which may be easily and efficiently manufactured and marketed.

It is a further object of the present invention to provide a new and improved game device which is of a durable and reliable construction.

An even further object of the present invention is to provide a new and improved game device which is susceptible of a low cost of manufacture with regard to both materials and labor, and which accordingly is then susceptible of low prices of sale to the consuming public, thereby making such game devices economically available to the buying public.

Still yet another object of the present invention is to provide a new and improved game device which provides in the apparatuses and methods of the prior art some of the advantages thereof, while simultaneously overcoming some of the disadvantages normally associated therewith.

Still another object of the present invention is to provide a new and improved game device for use in playing a fast paced word game which utilizes a motorized wheel for the random selection of letters of the alphabet.

Yet another object of the present invention is to provide a new and improved game device for use in playing a fast paced word game which utilizes a motorized spinning wheel which may be activated independently by a plurality of different switches.

Even still another object of the present invention is to provide a new and improved game device for use in playing a fast paced word game which utilizes a motorized wheel to randomly select a letter of the alphabet and a score sheet listing various categories to be completed by a word beginning with the randomly selected letter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a representational view of a score sheet utilized in the play of the game of the present invention.

DESCRIPTION OF THE PREFERRED EMBODIMENT

Figure 1:
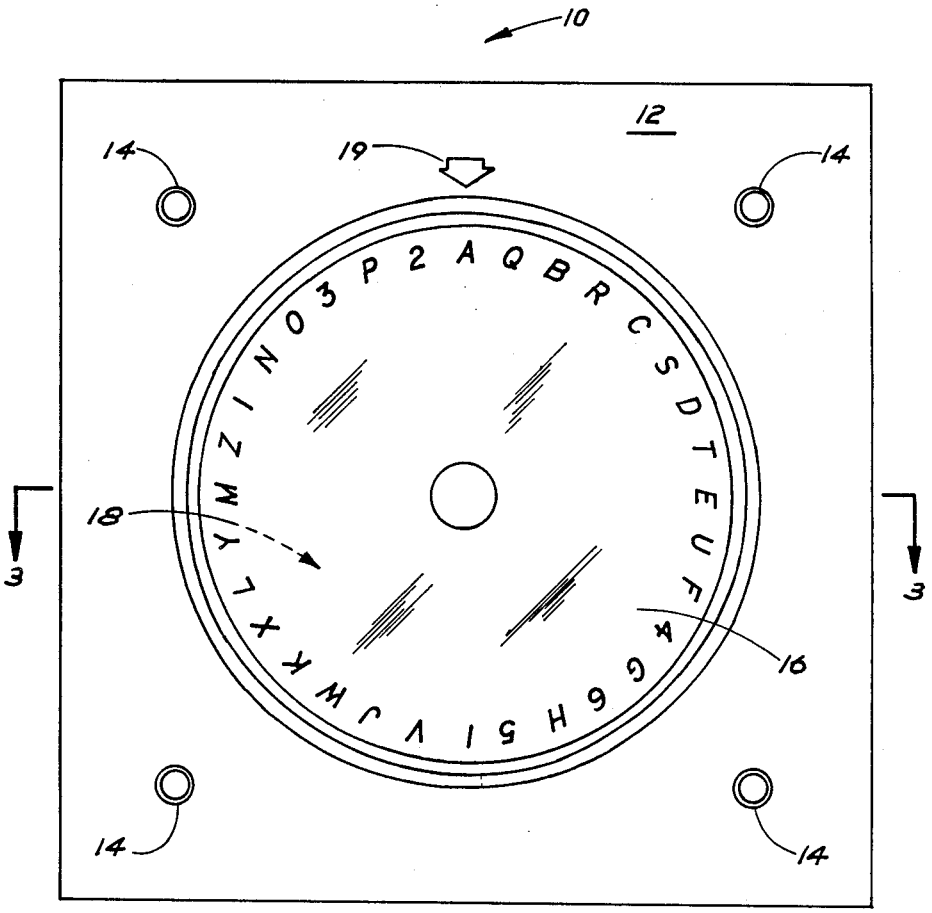
FIG. 1 is a top plan view of the alphabet wheel of the present invention.

With reference now to the drawings, and in particular to FIG. 1 thereof, a new and improved game device embodying the principles and concepts of the present invention and generally designated by the reference numeral 10 will be described.

More specifically, it will be noted that the first embodiment 10 of the invention includes a generally rectangular hollow housing 12. A plurality of switches 14 are mounted on the upper face of the housing 12, adjacent each corner portion thereof. A glass or transparent plastic cover 16 encloses a rotatably mounted wheel 18. As illustrated, the letters of the alphabet are inscribed about the periphery of the top face of the wheel 18. Various numbers, one through six illustrated, are interspersed among the letters. An indicating pointer 19 adjacent an upper edge portion of the top face of the housing 12, serves to indicate the letter or number selected upon stopping of the rotatable wheel 18. By depressing any one of the switches 14, a player may cause a motor to rotate the wheel 18. When the switch 14 is released, the wheel will coast to a stop, with a letter or number adjacent the indicator 19.

Figure 2:
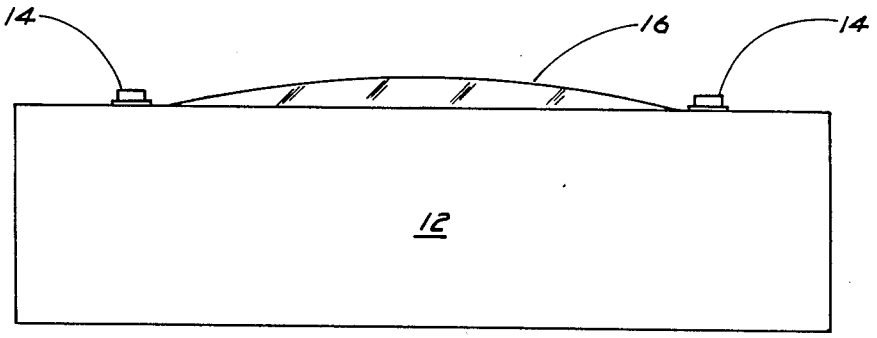
FIG. 2 is a side plan elevational view of the alphabet wheel of the present invention.

With reference now to FIG. 2, it may be seen that the glass or transparent plastic cover 16 is slightly convex and thus extends above the top face of the housing 12.

Figure 3:
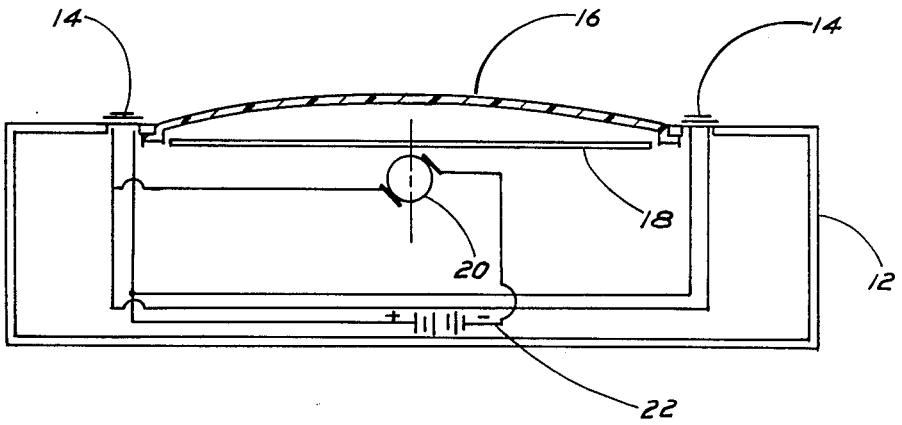
FIG. 3 is a cross sectional view of the alphabet wheel of the present invention taken along lines 3—3 of FIG. 1.

As shown in FIG. 3, a motor 20 is connected to rotating wheel 18. A conventional power source, such as a nine volt battery 22, is connected via a plurality of switches 14 to the motor 20. It will be noted that each of the switches 14 is wired in parallel, so that activation of any one of the switches 14 will energize the motor 20. As illustrated, the motor 20 and battery 22 are received within the hollow interior of the housing 12. Suitable access compartments may be provided for purposes of servicing these components.

Figure 4:
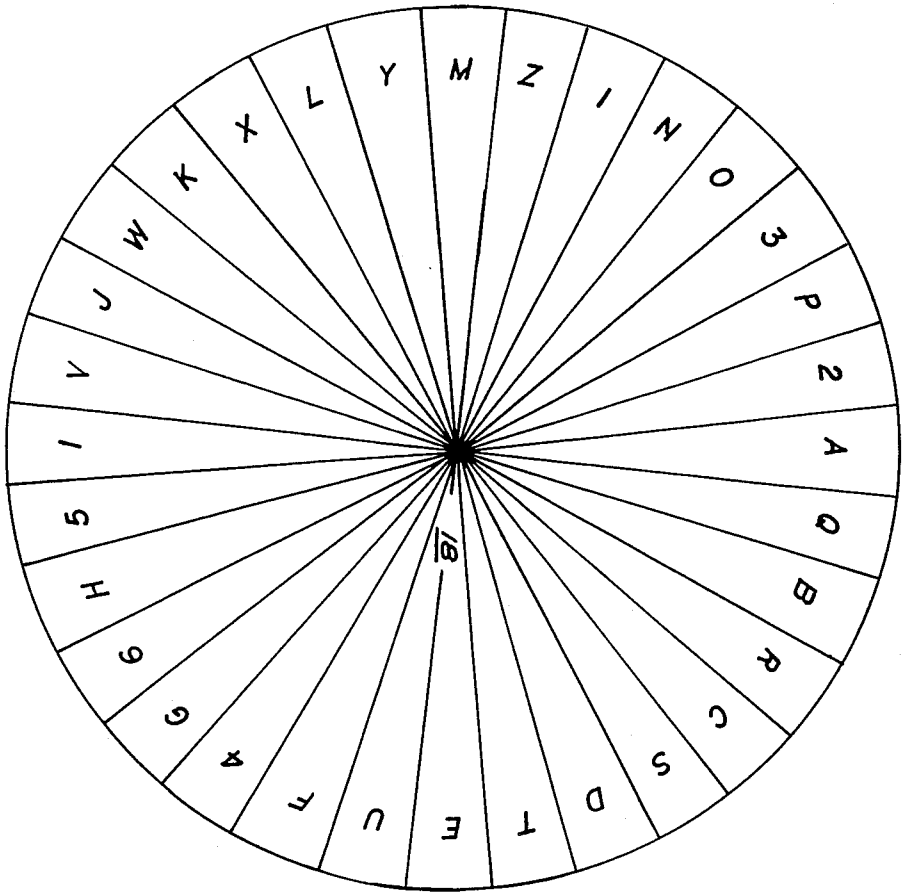
FIG. 4 is a top plan view of the imprinted alphabet wheel of the present invention.

FIG. 4 depicts an enlarged view of the preferred construction of the wheel 18 of the present invention. As shown, each of the letters and numbers inscribed on the periphery of the wheel is contained within a section designated by radially extending lines. These radially extending lines, in conjunction with the indicating pointer 19, define a zone of selection for each of the letters and numbers.

With reference now to FIG. 5, an exemplary score sheet for use in the play of the game of the present invention, will now be described. Various different subject titles extend down the left hand edge of the score sheet. Although various subjects may be selected, the preferred subjects include name, fruit, city, item, animal, color, car, country, flower and famous people. The numbers one through five contained in columns extending horizontally across the top of the score sheet serve to indicate the spin number of the wheel for each category currently being completed. A column at the right hand edge of the score sheet serves to indicate the point value associated with each subject. A blank row extending horizontally across the bottom of the score sheet is utilized to tally the player's score.

With reference now to FIGS. 1 and 5, the manner of play of the game of the present invention will now be described. The game is designed for play from two to six players. However, the game can be adapted for play by additional players by adding more numbers on the wheel 18. At the start of the game, each player selects one number between one and six. In subsequent course of the play, if the spinning wheel 18 stops with a player's selected number beneath the pointer 19, the player will receive ten bonus points. To begin the game, one player depresses one of the buttons 14 for a few seconds, until the wheel 18 begins spinning rapidly. At this point, the player releases the button 14, and the wheel 18 coasts to a stop. The selected letter may be determined by comparison of the wheel 18 with the pointing indicator 19. The players must then complete column one with a word fitting each subject category beginning with the letter indicated by pointer 19. For example, if the indicated letter is a B, the name category could be completed with BOB, the fruit category could be completed with BANANA, the city category could be completed with BALTIMORE, etc. When one of the players has completed each of the subject categories in column one, he then depresses one of the buttons 14, to begin the wheel spinning, regardless of the stage of completion of the other players' score sheets. When the wheel 18 stops again, indicating a new letter, column two is completed in accordance with the indicated letter in the previously described manner. The game proceeds in this fashion, until one of the players has completed the entire score sheet. At this point play is halted, and the other players are prohibited from filling in additional blocks on their score sheets. The first player to finish is the winner, and the finishing rank of the other players is determined by tallying their total point scores.

It should be noted that the score sheet 24 of the present invention may be formed from a darkly imprinted plastic sheet, thereby enabling players to utilized plain paper placed over the score sheet. Each player may then see through the piece of plain paper and write the answer in the appropriate block. This alleviates the necessity of utilizing specially printed score sheets. Alternatively, specially printed score sheets may be supplied with the game.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a fast paced word game, comprising the steps of:

providing:

a generally rectangular hollow housing;

a circular wheel mounted for rotation within said housing, said wheel having a face exposed through an opening in said housing;

said wheel having letters of the alphabet and the numbers one through six imprinted thereon;

electrical motor means mounted within said housing operatively connected for rotating said wheel;

a battery mounted within said housing and operatively connected for powering said motor;

a plurality of independent switches mounted on an exposed face of said housing, said switches being connected in parallel between said battery and said motor for independently energizing said motor;

a convex transparent cover mounted on said housing and covering said wheel;

a score sheet for each of a plurality of players, said score sheet formed from plastic designated with categories including name, fruit, city, item, animal, color, car, country, flower, and famous people categories, a point score associated with each of said categories designated on said score sheet, and said score sheet also designated with a plurality of adjacent columns;

selecting one of said wheel numbers by each of a plurality of players;

spinning said wheel by one of said players and randomly indicating a number or letter by activating one of said independent switches;

recording bonus points on a player's score sheet if a player's selected number is indicated;

completing one of said score sheet columns by writing a word beginning with a selected letter in each of said categories;

repeatedly spinning said wheel upon completion of one of said score sheet columns by one of said plurality of players;

repeatedly completing said score sheet columns with words in each category beginning with randomly selected letters; and totalling said score sheet point totals upon completion of all of said score sheet columns by one of said players, to determine the game winner.

* * * * *